US011745308B2

(12) United States Patent
Hayashi

(10) Patent No.: US 11,745,308 B2
(45) Date of Patent: Sep. 5, 2023

(54) AUTOMATIC WET SANDING APPARATUS

(71) Applicant: TOYOTA JIDOSHA KABUSHIKI KAISHA, Toyota (JP)

(72) Inventor: Ryuji Hayashi, Tahara (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 283 days.

(21) Appl. No.: 17/136,268

(22) Filed: Dec. 29, 2020

(65) Prior Publication Data

US 2021/0276149 A1 Sep. 9, 2021

(30) Foreign Application Priority Data

Mar. 5, 2020 (JP) ..... 2020-037961

(51) Int. Cl.
*B24B 57/02* (2006.01)
*B24B 5/36* (2006.01)

(52) U.S. Cl.
CPC ..... *B24B 57/02* (2013.01); *B24B 5/36* (2013.01)

(58) Field of Classification Search
CPC B24B 57/02; B24B 5/36; B24B 55/02; B24B 19/26
USPC ..... 451/259, 344, 357, 367, 456
See application file for complete search history.

(56) References Cited

U.S. PATENT DOCUMENTS 4,531,329 A * 7/1985 Huber ..... B24B 55/102 451/344
5,597,348 A * 1/1997 Hutchins ..... B24B 23/03 451/295
6,190,245 B1 * 2/2001 Heidelberger ..... B24B 55/105 451/357
7,118,452 B2 * 10/2006 Wood ..... B24B 27/0038 451/158
11,383,344 B2 * 7/2022 Guha ..... B25J 11/0065

FOREIGN PATENT DOCUMENTS

CN 107471116 A 12/2017
JP 58-67377 A 4/1983

* cited by examiner

*Primary Examiner* — Joel D Crandall
*Assistant Examiner* — Shantese L McDonald
(74) *Attorney, Agent, or Firm* — Oblon, McClelland, Maier & Neustadt, L.L.P.

(57) ABSTRACT

To change the direction of water flowing toward a painted surface so as to flow toward the center side of a hood, a water deflecting member is provided that extends toward the center side of the hood while extending toward the painted surface as seen in a state where automatic wet sanding is performed. Thus, water bouncing off the painted surface is less likely to scatter over a wide area of the painted surface, and sanding dust is also less likely to scatter over a wide area of the painted surface. As a result, it is possible to eliminate the need for the troublesome task of wiping off sanding dust remaining on the painted surface, and to achieve a quality finish on the painted surface.

3 Claims, 11 Drawing Sheets

AUTOMATIC WET SANDING APPARATUS

CROSS-RFFERENCE TO RELATED APPLICATION

This application claims priority to Japanese Patent Application No. 2020-037961 filed on Mar. 5, 2020, incorporated herein by reference in its entirety.

BACKGROUND

1. Technical Field

The present disclosure relates to an automatic wet sanding apparatus. In particular, the disclosure relates to measures for preventing scattering of water bouncing off a painted surface of a painted object.

2. Description of Related Art

An automatic wet sanding apparatus has been hitherto known that performs automatic wet sanding on painted surfaces of vehicle bodies after completion of a painting process in an automobile production line, for example, as disclosed in Japanese Patent Application Publication No. 58-67377.

This automatic wet sanding apparatus includes an automatic wet sanding unit that is mounted on an automatic wet sanding robot (e.g., an articulated robot). The automatic wet sanding unit includes a sanding sliding body, such as a sanding brush or sandpaper. In an automatic wet sanding process, the sanding sliding body is pressed against a painted surface, and the automatic wet sanding robot is operated to move the sanding sliding body along the painted surface, with water flowing between the sanding sliding body and the painted surface, so as to sand down the painted surface. Sanding dust, such as paint dust, resulting from sanding down a painted surface is washed off the painted surface by the water.

SUMMARY

However, in a situation where water from the automatic wet sanding unit is supplied toward a painted surface, this water may bounce off the painted surface and scatter over a wide area of the painted surface. The bouncing water contains sanding dust, and therefore if this water scatters over a wide area of the painted surface (a wide area on the outer side of the automatic wet sanding unit), the sanding dust will also scatter over a wide area of the painted surface. This will end up with the sanding dust remaining on the painted surface when water on the painted surface evaporates after completion of automatic wet sanding.

Thus, the troublesome task of wiping off the remaining sanding dust is needed, and if not fully wiped off, the sanding dust may adversely affect the finish on the painted surface.

As an effective measure to prevent sanding dust from remaining on a painted surface, the inventor of the present disclosure focused on preventing water bouncing off the painted surface from scattering over a wide area of the painted surface.

The present disclosure has been contrived in view of the above-described issue, and an object thereof is to provide an automatic wet sanding apparatus that can prevent scattering of water bouncing off a painted surface of a painted object.

A solution adopted by the present disclosure to achieve the above object is premised on an automatic wet sanding apparatus that performs automatic wet sanding in which a sanding sliding body is pressed against a painted surface of a painted object that has been painted and, while water is supplied toward the painted surface, the sanding sliding body is moved to sand down the painted surface. This automatic wet sanding apparatus includes: a case that forms an introduction space of the water; a water supply pipe that supplies the water to the introduction space; a disc that moves integrally with the sanding sliding body and is located closer to the painted surface than the introduction space is in a state where the automatic wet sanding is performed; a hood that is mounted on an outer circumferential part of the case and, as seen in the state where the automatic wet sanding is performed, extends toward the painted surface so as to be located on the outer circumferential side of the disc; and a water deflecting member that is mounted at a leading end of the hood closer to the painted surface and, as seen in the state where the automatic wet sanding is performed, extends toward the center side of the hood while extending toward the painted surface.

According to these specifications, automatic wet sanding of sanding down a painted surface of a painted object is performed by pressing the sanding sliding body against the painted surface and moving the sanding sliding body to sand down the painted surface while water supplied to the introduction space inside the case through the water supply pipe is supplied toward the painted surface. When a situation arises where water supplied to the introduction space is released to the outer circumferential side along the disc, this water collides with an inner surface of the hood located on the outer circumferential side and is then guided from the inner surface of the hood to an inner surface of the water deflecting member. Since the water deflecting member is shaped to extend toward the center side of the hood while extending toward the painted surface, the water flowing toward the painted surface along the water deflecting member flows toward the center side of the hood while flowing toward the painted surface. Therefore, when this water bounces off the painted surface, the bouncing water is directed toward the center side of the hood while flowing away from the painted surface. Creating such a flow of water can reduce the likelihood that water bouncing off the painted surface may scatter over a wide area of the painted surface. Since the bouncing water, which contains sanding dust, is less likely to scatter, the sanding dust is also less likely to scatter over a wide area of the painted surface. Thus, sanding dust is less likely to remain on the painted surface after completion of automatic wet sanding. As a result, it is possible to achieve a quality finish on the painted surface while eliminating the need for the troublesome task of wiping off remaining sanding dust.

The water deflecting member may be made of rubber.

According to this configuration, the water deflecting member can hinder the hood (which is made of, for example, metal) from coming directly into contact with the painted surface when the angle of the case or the disc relative to the painted surface of the painted object changes. Even if the water deflecting member comes into contact with the painted surface, the water deflecting member, being made of rubber, is less likely to damage the painted surface and thus the painted surface can be protected.

The diameter of the end edge of the water deflecting member closer to the painted surface may be set to be smaller than the diameter of a mounting part of the water deflecting member that is mounted on the hood.

According to this configuration, simply mounting the mounting part of the water deflecting member onto the leading end of the hood closer to the painted surface can set the water deflecting member in the state of extending toward the center side of the hood while extending toward the painted surface.

The automatic wet sanding apparatus may further include a cushion pad which moves integrally with the disc and on which the sanding sliding body is mounted, and the position of a leading end edge of the hood closer to the painted surface may be set to a position that is on a side farther away from the painted object than a position in the disc that is closer to the painted surface is.

According to this configuration, there is a clearance, wider than the thickness of the cushion pad, between the painted surface and the leading end edge of the hood closer to the painted surface. Thus, a sufficient clearance between the hood and the painted surface can be secured to hinder the hood from coming close to the painted surface and protect the painted surface.

In the present disclosure, to change the direction of water flowing toward a painted surface so as to flow toward the center side of the hood, the water deflecting member is provided that extends toward the center side of the hood while extending toward the painted surface as seen in a state where automatic wet sanding is performed. Thus, water bouncing off the painted surface is less likely to scatter over a wide area of the painted surface, and sanding dust is also less likely to scatter over a wide area of the painted surface. As a result, it is possible to achieve a quality finish on the painted surface while eliminating the need for the troublesome task of wiping off sanding dust remaining on the painted surface.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

An embodiment of the present disclosure will be described below based on the drawings. In this embodiment, a case will be described where the disclosure is applied to an automatic wet sanding apparatus that is provided on an automobile production line and performs automatic wet sanding on painted surfaces of vehicle bodies.

Schematic Configuration of Automatic Wet Sanding Station

Figure 1:
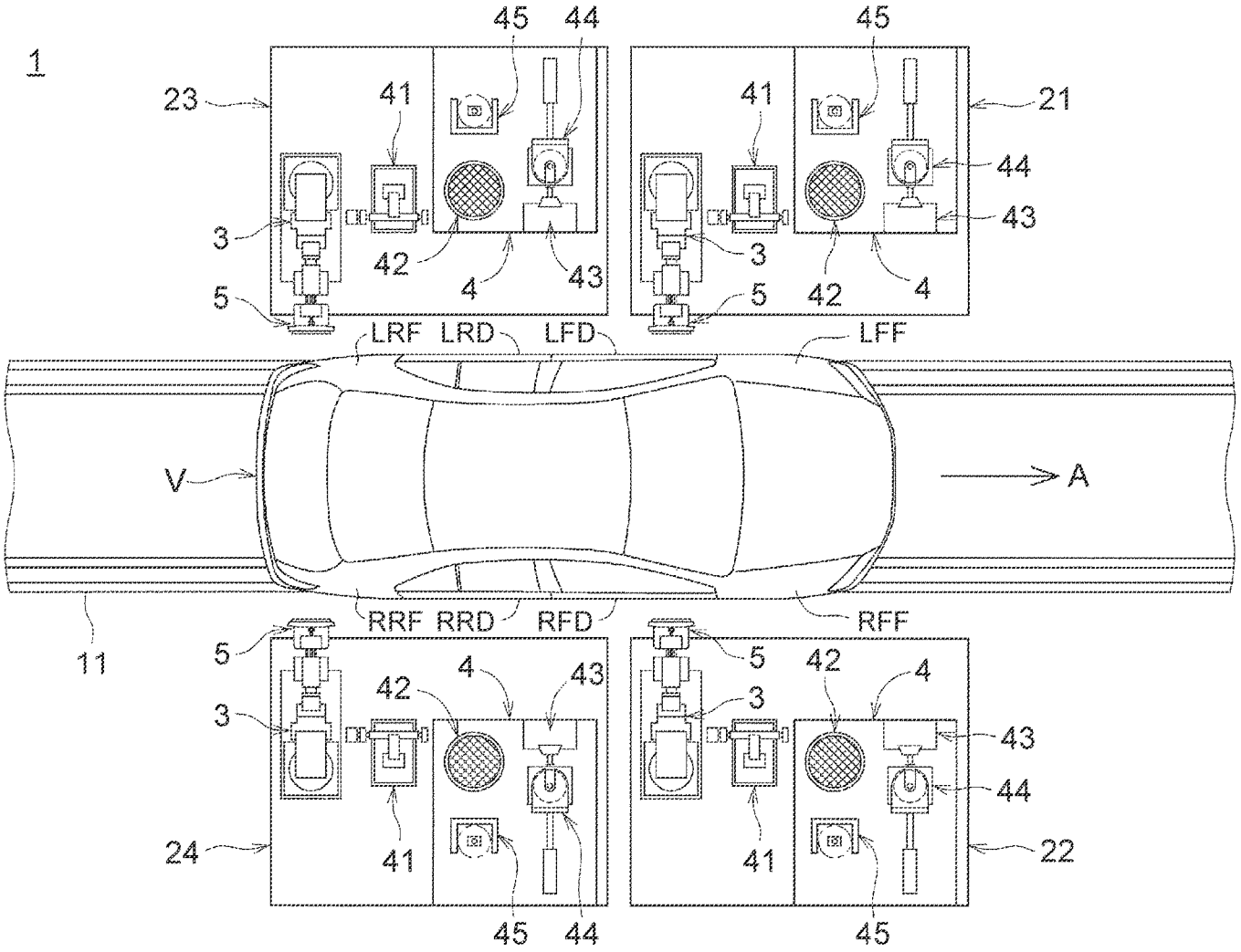
FIG. 1 is a schematic configuration view of an automatic wet sanding station in an embodiment.

First, a schematic configuration of an automatic wet sanding station on an automobile production line in which automatic wet sanding apparatuses are installed will be described. FIG. 1 is a schematic configuration view of an automatic wet sanding station 1 in this embodiment. The automatic wet sanding station 1 is installed on the automobile production line, on a downstream side of a painting station (not shown).

As shown in FIG. 1, the automatic wet sanding station 1 has a configuration in which four automatic wet sanding apparatuses 21, 22, 23, 24 are installed two on each side of a conveyor 11 that transfers vehicle bodies V.

When the vehicle body V is transferred as indicated by arrow A in FIG. 1 (when the vehicle body V is transferred on the conveyor 11 from the left side toward the right side in FIG. 1), the automatic wet sanding apparatuses 21, 22 located on a downstream side in the transfer direction perform automatic wet sanding on painted surfaces of front doors LFD, RFD and front fenders LFF, RFF of the vehicle body V. Specifically, the automatic wet sanding apparatus 21 (hereinafter referred to as a first automatic wet sanding apparatus 21) located on the left side as seen from the transfer direction (the upper side in FIG. 1) performs automatic wet sanding on the painted surfaces of the left front door LFD and the left front fender LFF of the vehicle body V. The automatic wet sanding apparatus 22 (hereinafter referred to as a second automatic wet sanding apparatus 22) located on the right side as seen from the transfer direction (the lower side in FIG. 1) performs automatic wet sanding on the painted surfaces of the right front door RFD and the right front fender RFF of the vehicle body V.

Meanwhile, the automatic wet sanding apparatuses 23, 24 located on an upstream side in the transfer direction perform automatic wet sanding on painted surfaces of rear doors LRD, RRD and rear fenders LRF, RRF of the vehicle body V. Specifically, the automatic wet sanding apparatus 23 (hereinafter referred to as a third automatic wet sanding apparatus 23) located on the left side as seen from the transfer direction performs automatic wet sanding on the painted surfaces of the left rear door LRD and the left rear fender LRF of the vehicle body V. The automatic wet sanding apparatus 24 (hereinafter referred to as a fourth automatic wet sanding apparatus 24) located on the right side as seen from the transfer direction performs automatic wet sanding on the painted surfaces of the right rear door RRD and the right rear fender RRF of the vehicle body V.

As the automatic wet sanding apparatuses 21 to 24 have the same configuration, the first automatic wet sanding apparatus 21 will be described here as a representative. In FIG. 1, those of the devices and members composing the automatic wet sanding apparatuses 21 to 24 that are the same are denoted by the same reference signs.

Figure 2:
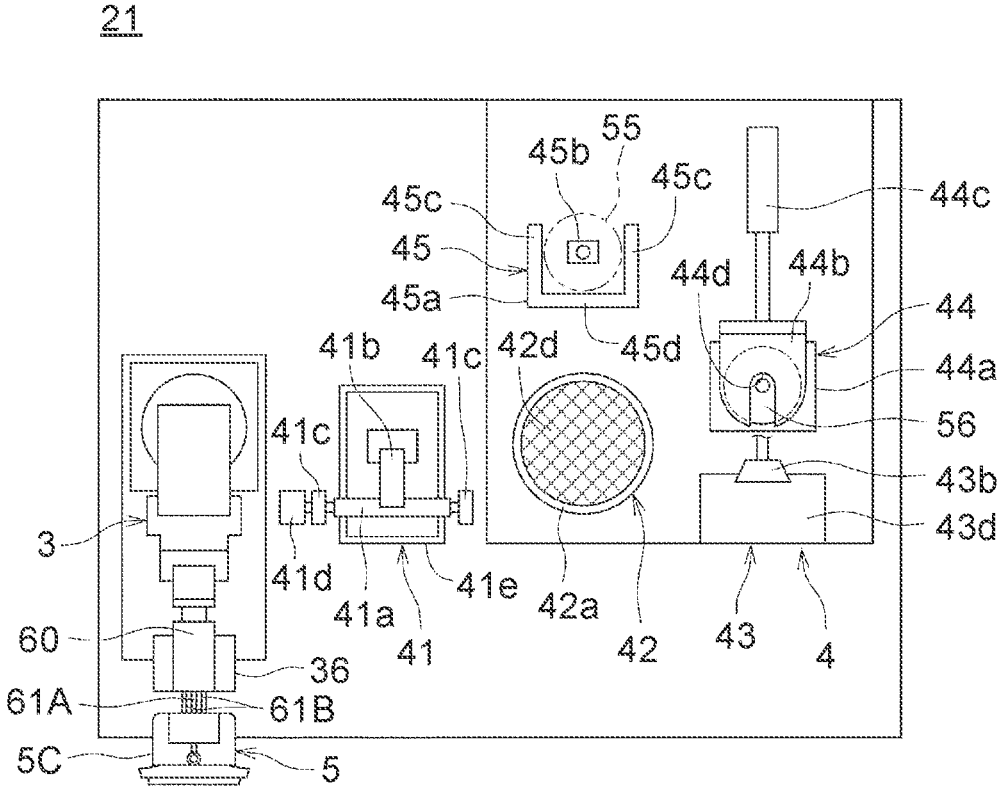
FIG. 2 is a schematic configuration view showing a first automatic wet sanding apparatus.

FIG. 2 is a schematic configuration view showing the first automatic wet sanding apparatus 21. As shown in FIG. 2, the first automatic wet sanding apparatus 21 includes an automatic wet sanding robot 3 and a changer 4. The automatic wet sanding robot 3 is formed by an articulated robot, and an automatic wet sanding unit 5 to be described later is mounted on the automatic wet sanding robot 3. Automatic wet sanding is performed on the painted surfaces of the vehicle body V (in the case of the first automatic wet sanding apparatus 21, the painted surfaces of the left front door LFD and the left front fender LFF) by the automatic wet sanding unit 5. The changer 4 replaces sandpaper (a "sanding sliding body" as termed in the present disclosure) that is mounted on the automatic wet sanding unit 5. In the following, the automatic wet sanding robot 3, the automatic wet sanding unit 5, and the changer 4 will be specifically described.

Automatic Wet Sanding Robot

Figure 3:
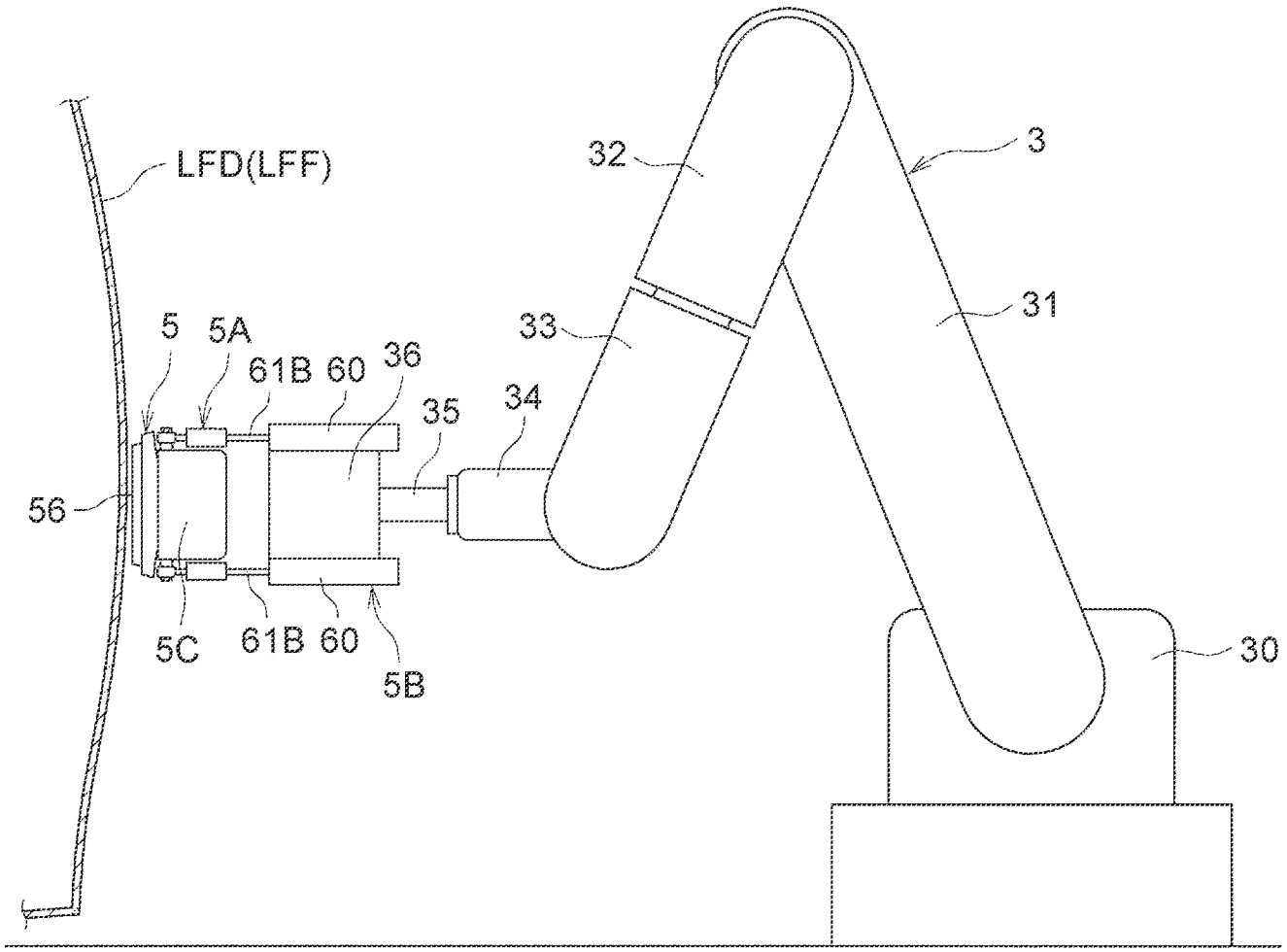
FIG. 3 is a view showing an automatic wet sanding robot.

As shown in FIG. 3, the automatic wet sanding robot 3 is formed by an articulated robot. Specifically, the automatic wet sanding robot 3 in this embodiment includes a swivel base 30, and first to fifth arms 31, 32, 33, 34, 35 that are coupled to one another by joints or the like.

A rotating mechanism (including a motor) that can rotate around a vertical axis is housed inside the swivel base 30. A rotating mechanism that can rotate around a horizontal axis is housed at each joint. The swivel base 30 and the first arm 31, the first arm 31 and the second arm 32, and the third arm 33 and the fourth arm 34 are coupled to each other by a joint having a rotating mechanism that arrows the arms 31, 32, 33, 34 to turn relatively. The second arm 32 and the third arm 33, and the fourth arm 34 and the fifth arm 35 are coupled to each other by a rotating mechanism that can rotate relatively around an axis along an extension direction of the arm. Rotational motion of these rotating mechanisms causes the swivel base 30 to rotate or the arms 31 to 35 to swing or rotate, which can in turn move the automatic wet sanding unit 5 to an arbitrary position or change the posture thereof to an arbitrary posture. Rotational motion of each rotating mechanism is performed based on a command signal from a robot controller 83 (see FIG. 8) to be described later.

The automatic wet sanding unit 5 is mounted at a leading end of the fifth arm 35. Specifically, the automatic wet sanding unit 5 is mounted on a frame 36 that is mounted at the leading end of the fifth arm 35.

The configuration of the automatic wet sanding robot 3 is not limited to the above-described one.

Automatic Wet Sanding Unit

Figure 4A:
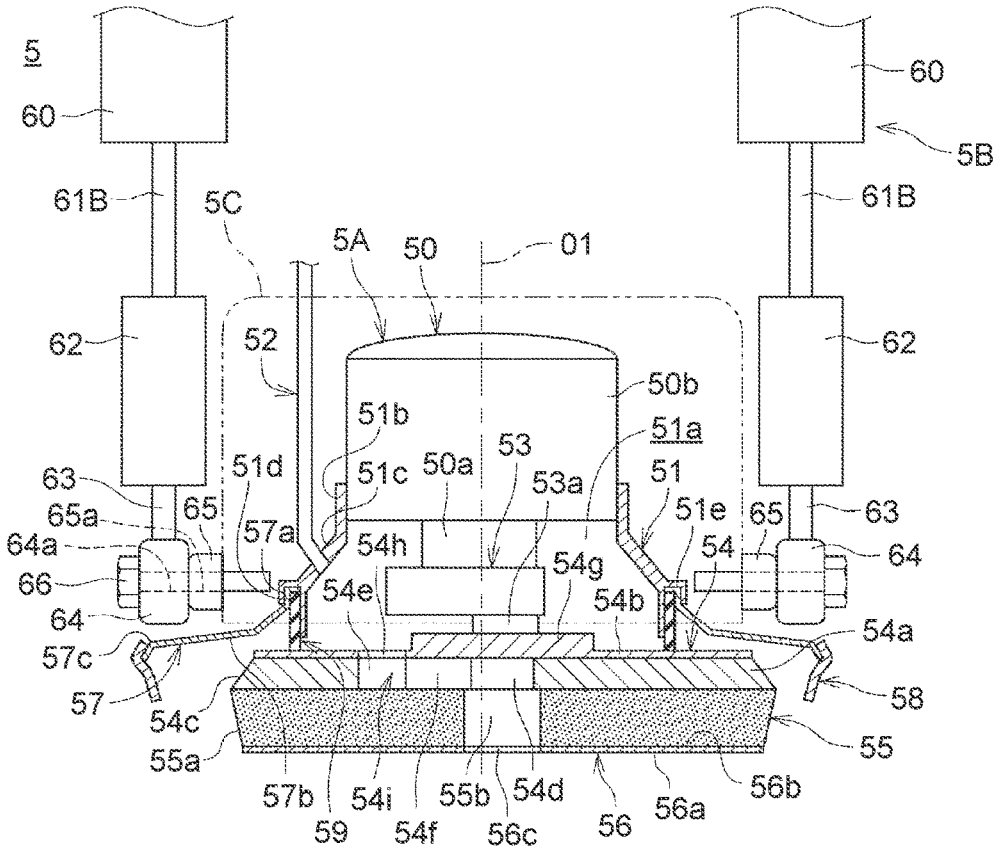
FIG. 4A is a vertical sectional view of an automatic wet sanding unit.
Figure 4B:
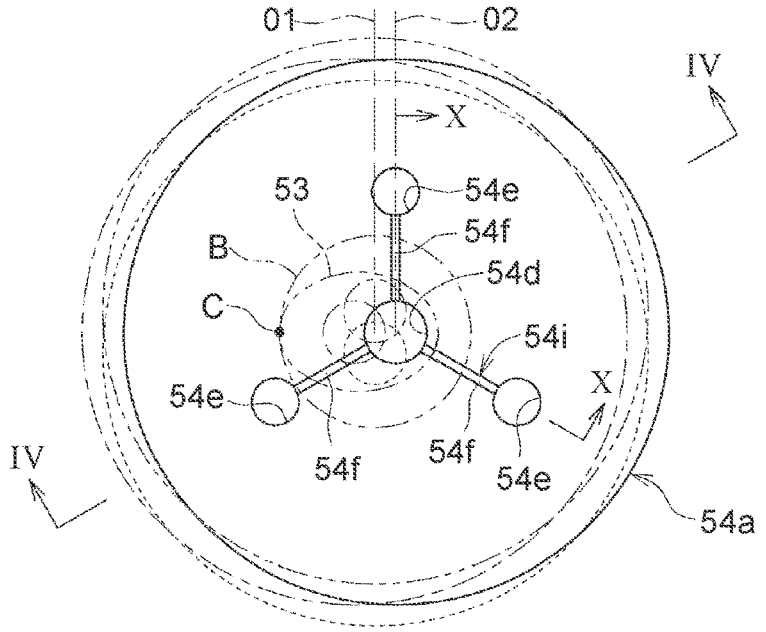
FIG. 4B is a schematic view showing a disc main body.

Next, the automatic wet sanding unit 5 will be described. FIG. 4A is a vertical sectional view of the automatic wet sanding unit 5. FIG. 4B is a schematic view showing a disc main body 54*a* to be described later (a schematic view of the disc main body 54*a* as seen from a direction along a central axis thereof). The vertical sectional view of FIG. 4A shows a section located at a position corresponding to line IV-IV in FIG. 4B.

The posture of the automatic wet sanding unit 5 (the automatic wet sanding unit 5 in the first automatic wet sanding apparatus 21) shown in FIG. 4A is a posture in which the sandpaper 56 mounted on the automatic wet sanding unit 5 faces downward. When automatic wet sanding is being performed, the automatic wet sanding unit 5 is in a posture in which the sandpaper 56 faces the painted surface (the surface extending in a substantially vertical direction) of the left front door LFD or the left front fender LFF of the vehicle body V as shown in FIG. 3, i.e., a posture to which the automatic wet sanding unit 5 turns about 90° from the posture shown in FIG. 4A so as to face the vehicle body V. Therefore, when automatic wet sanding is being performed, a downward direction in FIG. 4A is a direction facing the vehicle body and an upward direction in FIG. 4A is a direction facing the opposite side from the vehicle body. In the following description of the automatic wet sanding unit 5 using FIGS. 4A and 4B, a state where the automatic wet sanding unit 5 is in the posture shown in FIG. 4A (the posture in which the sandpaper 56 faces downward) will be taken as an example.

As shown in FIG. 4A, the automatic wet sanding unit 5 includes a unit main body 5A and a unit support mechanism 5B that is mounted on the frame 36. Thus, the unit main body 5A is supported by the automatic wet sanding robot 3 through the unit support mechanism 5B and the frame 36 (more specifically, supported at the leading end of the fifth arm 35 of the automatic wet sanding robot 3 through the unit support mechanism 5B and the frame 36).

Unit Main Body

The unit main body 5A includes an air motor 50, a skirt (a "case" as termed in the present disclosure) 51, a water supply pipe 52, an eccentric head 53, a disc 54, a cushion pad 55, sandpaper (the "sanding sliding body" as termed in the present disclosure) 56, a hood 57, a water deflecting member 58, and a seal member 59.

Air Motor

The air motor 50 includes a driving shaft 50*a* that extends downward in the posture shown in FIG. 4A. An air supply pipe (not shown) is connected to the air motor 50, and the driving shaft 50*a* is rotated by the pressure of air supplied through the air supply pipe as an air pump (not shown) is activated. Long dashed short dashed line O1 in FIG. 4A indicates the center of rotation of the driving shaft 50*a*.

Skirt

The skirt 51 is integrally mounted on a casing 50*b* of the air motor 50, and an inside of the skirt 51 forms an introduction space 51*a* into which water for automatic wet sanding is introduced. Specifically, the skirt 51 includes a cylindrical mounting part 51*b*, a skirt main part 51*c* of which the diameter increases from a lower end edge of the mounting part 51*b* toward a lower side, and a hood mounting part 51*d* that extends cylindrically from a lower end edge of the skirt main part 51*c* toward the lower side.

The inside diameter of the mounting part 51*b* is substantially equal to the outside diameter of the casing 50*b* of the air motor 50. An inner circumferential surface of the mounting part 51*b* is joined to an outer circumferential surface of the casing 50*b* of the air motor 50. Thus, the skirt 51 is supported by the air motor 50. Since the diameter of the skirt main part 51*c* increases toward the lower side as mentioned above, the inside diameter of the introduction space 51*a* inside the skirt main part 51*c* also increases toward the lower side. The hood mounting part 51*d* has an annular engaging groove 51*e* that is depressed toward an upper side by a predetermined dimension from a lower end surface of the hood mounting part 51*d*. The engaging groove 51*e* is used to fix the hood 57 and the seal member 59 to be described later.

Water Supply Pipe

The water supply pipe 52 supplies water for automatic wet sanding into the introduction space 51*a* of the skirt 51. The water supply pipe 52 is connected at an upstream end to a water pump 52*a* (see FIG. 8) and at a downstream end to the skirt main part 51*c* of the skirt 51, and supplies water for automatic wet sanding into the introduction space 51*a* of the skirt 51 as the water pump 52*a* is activated.

Eccentric Head

The eccentric head 53 is integrated with the driving shaft 50*a* of the air motor 50, and is formed so as to have its center offset from the center of rotation O1 of the driving shaft 50*a*.

FIGS. 4A and 4B show a state where the center of the eccentric head 53 is offset toward the left side in FIGS. 4A and 4B. As indicated by the imaginary line in FIG. 4B, the eccentric head 53 is formed by a substantially elliptical disc, and a position in the eccentric head 53 that is located off the center position of the ellipse (in FIG. 4B, an off-center position on the right side) is located on the center of rotation O1 of the driving shaft 50*a*. Therefore, when the driving shaft 50*a* rotates (around the center of rotation O1) as the air motor 50 is activated, the eccentric head 53 rotates eccentrically around the center of rotation O1. Imaginary line B in FIG. 4B indicates a trajectory of movement of an outer end of the eccentric head 53 (a position at an outer edge thereof on the offset side; point C in FIG. 4B) when the eccentric head 53 rotates eccentrically. As this imaginary line B shows, the outer end (the position at the outer edge on the offset side) of the eccentric head 53 is located on an inner circumferential side relative to outer circumferential ends of disc holes 54*e* to be described later.

Disc

The disc 54 is composed of a disc main body 54*a* and a disc cover 54*b* that are integrally combined.

The disc main body 54*a* is formed by a metal disc that has a larger diameter than the hood mounting part 51*d* of the skirt 51. An outer circumferential surface 54*c* of the disc main body 54*a* is formed by a sloping surface of which the diameter increases downward.

As shown in FIG. 4B, the disc main body 54*a* has a disc center hole 54*d*, the disc holes 54*e*, and communication passages 54*f*.

The disc center hole 54*d* is formed by a circular opening that is bored at a central portion of the disc main body 54*a*. The disc center hole 54*d* extends from an upper surface to a lower surface of the disc main body 54*a*.

The disc holes 54*e* are formed at three positions on an outer circumferential side, each at a predetermined distance from the center of the disc main body 54*a*. The disc holes 54*e* also extend from the upper surface to the lower surface of the disc main body 54*a*. The disc holes 54*e* are disposed at positions at regular angular intervals in a circumferential direction (positions at 120° angular intervals).

The communication passages 54*f* allow communication between the disc center hole 54*d* and the disc holes 54*e*. Specifically, the communication passages 54*f* extend radially from the center of the disc main body 54*a* and each communicate at an inner end with the disc center hole 54*d* and at an outer end with the disc hole 54*e*. The communication passages 54*f* also extend from the upper surface to the lower surface of the disc main body 54*a*.

The disc cover 54*b* is formed by a metal disc that has an outside diameter substantially equal to the outside diameter of the upper surface of the disc main body 54*a*. The disc cover 54*b* has a bearing part 54*g* which is a part provided at a central portion and at which the plate thickness of the disc cover 54*b* is increased. The bearing part 54*g* and the eccentric head 53 are connected to each other by a bearing 53*a*. Thus, the disc cover 54*b* is rotatably supported by the eccentric head 53. The disc cover 54*b* is rotatably supported by the eccentric head 53, for example, as an inner race of the bearing 53*a* is coupled to the eccentric head 53 while an outer race of the bearing 53*a* is coupled to the bearing part 54*g* of the disc cover 54*b*.

Further, the disc cover 54*b* has openings 54*h* at positions corresponding to the disc holes 54*e* of the disc main body 54*a*. The inside diameter of the opening 54*h* is substantially equal to the inside diameter of the disc hole 54*e*. With the positions of the openings 54*h* coinciding with the positions of the disc holes 54*e*, the disc cover 54*b* is joined to the upper surface of the disc main body 54*a* by means such as screw fastening or welding. This means that the disc center hole 54*d* and the communication passages 54*f* are closed at an upper side by the disc cover 54*b*. Thus, in the disc 54, a water channel 54*i* is formed that continues through the openings 54*h* of the disc cover 54*b* and the disc holes 54*e*, the communication passages 54*f*, and the disc center hole 54*d* of the disc main body 54*a*. Since the disc cover 54*b* is joined to the upper surface of the disc main body 54*a* as mentioned above, the entire disc 54 is rotatably supported by the eccentric head 53 through the bearing 53*a*.

The center position of the disc main body 54*a*, the center position of the disc cover 54*b*, the center position of the disc center hole 54*d*, and the center of rotation of the bearing 53*a* are located on the same axis (see O2 in FIG. 4B). In FIG. 4B, the positions of the disc 54 when the disc 54 rotates around the center position O2 by 90° at a time are indicated by the solid line, the dashed line, the long dashed short dashed line, and the long dashed double-short dashed line, respectively. The dimension of offset of the center position O2 of the disc center hole 54*d* (the center position of the disc 54) relative to the center of rotation O1 of the driving shaft 50*a* of the air motor 50 is set to be smaller than half the inside diameter of the disc center hole 54*d*.

Cushion Pad

The cushion pad 55 is integrally mounted on the lower surface of the disc 54. The cushion pad 55 is formed by a cushion member made of sponge or the like and has a form of a disc of which the outside diameter is substantially equal to the outside diameter of the disc main body 54*a*. An outer circumferential surface 55*a* of the cushion pad 55 is formed by a sloping surface of which the diameter decreases toward the lower side.

As shown in FIG. 4A, the cushion pad 55 has, at a central portion thereof, a pad center hole 55*b* that is formed by a circular opening. The pad center hole 55*b* extends from an upper surface to a lower surface of the cushion pad 55. The center position of the pad center hole 55*b* coincides with the center position of the disc center hole 54*d*. Thus, the pad center hole 55*b* communicates with the water channel 54*i* formed in the disc 54. The inside diameter of the pad center hole 55*b* is slightly larger than the inside diameter of the disc center hole 54*d*.

Sandpaper

The sandpaper 56 is detachably mounted on the lower surface of the cushion pad 55. Specifically, a lower surface 56*a* (a surface that faces the vehicle body V during automatic wet sanding) of the sandpaper 56 is a sanding surface. For example, this sanding surface is composed of resin. On the other hand, an upper surface 56*b* (a surface mounted to the lower surface of the cushion pad 55) is mounted to the lower surface of the cushion pad 55 by a touch-and-close fastener, such as Magictape®.

The sandpaper 56 has, at a central portion thereof, a paper center hole 56*c* that is formed by a circular opening. In a state where the sandpaper 56 is mounted at a correct position on the lower surface of the cushion pad 55, the center position of the paper center hole 56*c* coincides with the center position of the pad center hole 55*b*. The inside diameter of the paper center hole 56*c* may be set to be equal to the inside diameter of the pad center hole 55*b* or slightly larger than the inside diameter of the pad center hole 55*b*.

Hood

The hood 57 is a member that is mounted at a lower end of the skirt 51 and prevents scattering of water that is released toward an outer periphery of the disc 54 after being introduced into the introduction space 51*a* of the skirt 51. (This release of water will be described later.) Specifically, the hood 57 includes a cylindrical mounting part 57*a*, a hood main part 57*b* of which the diameter increases from a lower end edge of the mounting part 57*a* toward the lower side, and a water deflecting part 57*c* that extends obliquely downward from a lower end edge of the hood main part 57*b*.

The diameter of the mounting part 57*a* is substantially equal to the diameter of the engaging groove 51*e* formed in the skirt 51. As the mounting part 57*a* is inserted into the engaging groove 51*e*, the hood 57 is supported by the skirt 51.

The outside diameter of the hood main part 57*b* is set to be slightly larger than the outside diameter of the disc 54.

The water deflecting part 57*c* is formed by a part that is slightly bent downward from an outer circumferential end of the hood main part 57*b*. The water deflecting part 57*c* is located on the outer circumferential side of the disc 54. Thus, as will be described later, inner surfaces of the hood main part 57*b* and the water deflecting part 57*c* can receive water that is released from an upper surface of the disc 54 toward the outer periphery of the disc 54 and deflect the flow direction of this water.

The position of a lower end edge of the hood 57 (the position of a leading end edge thereof closer to the painted surface during automatic wet sanding, which is the position of a leading end edge of the water deflecting part 57*c*) is set to a position on a side farther away from the vehicle body V than the position of the lower surface of the disc 54 (which is a position closer to the painted surface during automatic wet sanding) is.

Water Deflecting Member

The water deflecting member 58 is formed by an annular rubber member that is mounted on the water deflecting part 57*c* of the hood 57 and that slopes toward an inner circumferential side (such that the diameter decreases) while extending downward from a lower end edge of the water deflecting part 57*c*. Specifically, the diameter of a lower end edge of the water deflecting member 58 (the end edge thereof closer to the painted surface in a state where automatic wet sanding is performed) is set to be smaller than the diameter of a mounting part thereof that is mounted on the water deflecting part 57*c* of the hood 57. As the water deflecting member 58 thus shaped is mounted on the water deflecting part 57*c* of the hood 57, the water deflecting member 58 extends toward the center side of the hood 57 while extending toward the painted surface as seen in the state where automatic wet sanding is performed. The water deflecting member 58 is mounted on the water deflecting part 57*c* by means such as bonding or screw fastening.

Seal Member

Like the hood 57, the seal member 59 is mounted at a lower end of the skirt 51. Specifically, the seal member 59 is formed by a flat cylindrical member made of urethane. The diameter of the seal member 59 is substantially equal to the diameter of the engaging groove 51*e* formed in the skirt 51. The seal member 59 is supported by the skirt 51 as an upper end portion of the seal member 59 is inserted into the engaging groove 51*e* while being overlapped with the mounting part 57*a* of the hood 57.

The height of the seal member 59 is substantially equal to the dimension of a clearance between a ceiling part inside the engaging groove 51*e* and the upper surface of the disc 54. Therefore, when no external pressure (e.g., water pressure) is acting on the seal member 59, a lower end of the seal member 59 is in contact with the upper surface of the disc 54 along an entire circumference of the seal member 59 (without clearance) as shown in FIG. 4A. Thus, the introduction space 51*a* of the skirt 51 can be turned into a substantially sealed space. When a water pressure acts on an inner side of the seal member 59 and this water pressure exceeds a predetermined value, the seal member 59 deforms elastically and a small clearance is formed between the lower end of the seal member 59 and the upper surface of the disc 54, and water flows through this clearance.

Unit Support Mechanism

Next, the unit support mechanism 5B will be described. As mentioned above, the unit support mechanism 5B is a mechanism that supports the unit main body 5A onto the automatic wet sanding robot 3 through the frame 36.

As shown in FIG. 3 and FIGS. 4A and 4B, the unit support mechanism 5B includes a pair of air cylinders 60. As shown in FIG. 3, the air cylinders 60 are respectively mounted on both side surfaces (an upper surface and a lower surface in FIG. 3) of the frame 36. From the air cylinders 60, one piston rod 61A and two guide rods 61B (see FIG. 2) protrude so as to be able to move forward and backward. The automatic wet sanding unit 5 includes a unit case 5C (see the imaginary line in FIG. 4A) that covers an outer side of the air motor 50 and the skirt 51. As shown in FIG. 4A, lower ends of the piston rod 61A and the guide rods 61B are connected to support blocks 62. One coupling rod 63 extends from a lower surface of each support block 62. A columnar rod end 64 is provided at a lower end of the coupling rod 63. The rod end 64 has, at a central portion thereof, a bolt insertion hole 64*a* that extends through the rod end 64 in a horizontal direction. A fastening nut 65 is mounted on an outer surface of the unit case 5C, at a position at which the fastening nut 65 faces the rod end 64. A bearing bolt 66 is screwed from outside into the bolt insertion hole 64*a* of the rod end 64 and a screw hole 65*a* of the fastening nut 65, and the unit case 5C is thereby turnably supported by the rod end 64. Thus, during automatic wet sanding, turning the unit case 5C relatively to the rod ends 64 can turn the entire automatic wet sanding unit 5 and thereby deflect the directions of the disc 54 and the cushion pad 55 to directions along the painted surface of the vehicle body V. As a result, a large area of the sanding surface (lower surface) 56*a* of the sandpaper 56 can be brought into contact with the painted surface of the vehicle body V.

Changer

Next, the changer 4 will be described. As shown in FIG. 2, the changer 4 includes a paper peeling unit 41, a pad cleaning unit 42, a pad draining unit 43, a paper mounting unit 44, and a paper checking unit 45.

Paper Peeling Unit

The paper peeling unit 41 peels (removes) the sandpaper 56 of the automatic wet sanding unit 5 from the cushion pad 55 upon completion of automatic wet sanding. If automatic wet sanding is performed on a plurality of vehicle bodies V using the same sandpaper 56 (without replacing the sandpaper 56), the sanding efficiency may decrease or paint of the vehicle body V that has previously undergone automatic wet sanding may transfer onto the subsequent vehicle body V. To avoid such a situation, the sandpaper 56 is replaced each time automatic wet sanding on one vehicle body V is completed. The paper peeling unit 41 performs a step of peeling the sandpaper 56 from the cushion pad 55 to replace the sandpaper 56.

The paper peeling unit 41 includes a clamping shaft 41*a* and a clamping hook 41*b*. The clamping shaft 41*a* is formed by a metal shaft that is supported by a frame 41*c* so as to be able to rotate around a horizontal axis. The clamping shaft 41*a* is coupled to a clamping shaft motor 41*d* and configured to be able to rotate as the clamping shaft motor 41*d* is activated. The clamping hook 41*b* is provided above and close to the clamping shaft 41*a*. Thus, the clamping hook 41*b* can catch the sandpaper 56 between the clamping hook 41*b* and the clamping shaft 41*a*.

A sandpaper collection box 41*e* is installed under the clamping shaft 41*a*, and the sandpaper 56 peeled from the cushion pad 55 drops into the sandpaper collection box 41*e* to be collected.

Pad Cleaning Unit

The pad cleaning unit 42 cleans the cushion pad 55 from which the sandpaper 56 has been peeled by the paper peeling unit 41. After automatic wet sanding, paint (paint separated from the vehicle body V by sanding; sanding dust) adheres to the sandpaper 56 and the cushion pad 55. Therefore, even when the sandpaper 56 is replaced, if automatic wet sanding is performed on the subsequent vehicle body V without cleaning the cushion pad 55, the paint may transfer onto the vehicle body V. The pad cleaning unit 42 is installed to avoid such a situation.

Figure 5:
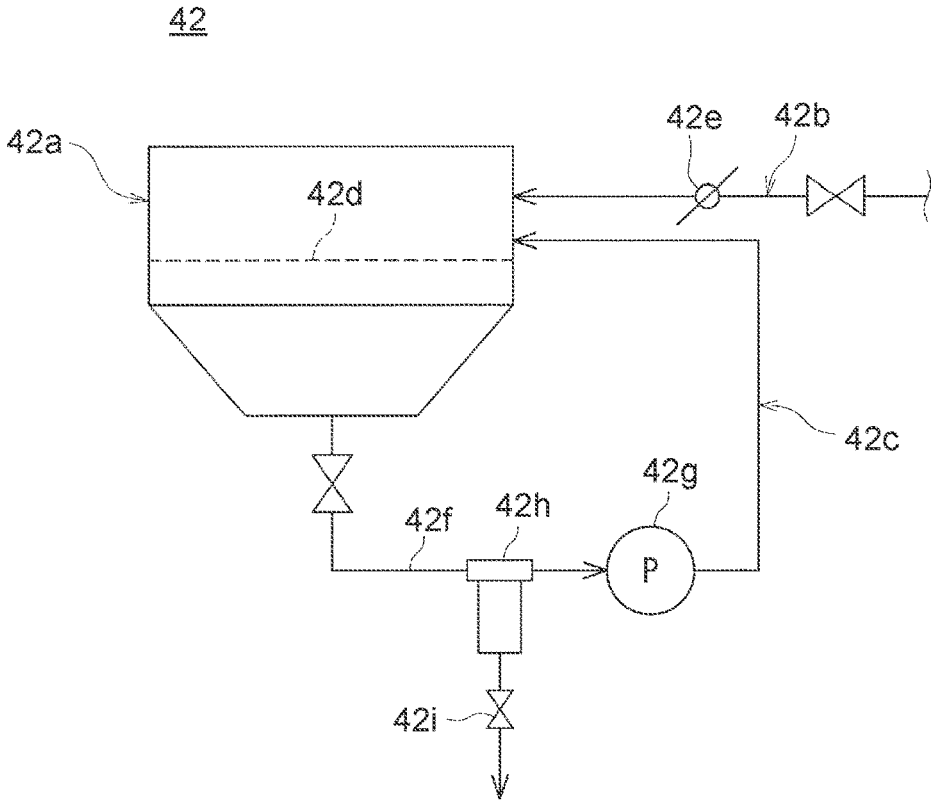
FIG. 5 is a schematic configuration view of a pad cleaning unit.

As shown in FIG. 5, the pad cleaning unit 42 includes a cleaning tank 42*a*, a water supply pipe 42*b*, and a circulating circuit 42*c*. The cleaning tank 42*a* has an inside diameter that is larger than the outside diameter of the automatic wet sanding unit 5. A metal mesh 42*d* extending in a horizontal direction is provided inside the cleaning tank 42*a*, at an intermediate point in a vertical direction (depth direction).

The water supply pipe 42*b* is connected at an upstream end to a water supply pump 42*j* (see FIG. 8) and at a downstream end to the cleaning tank 42*a*, and supplies cleaning water (pure water) to the cleaning tank 42*a* as the water supply pump 42*j* is activated. A valve 42*e* for regulating water supply is provided on the water supply pipe 42*b*.

The circulating circuit 42*c* has a configuration in which a circulating pump 42*g* and a filter 42*h* are provided on the route of a circulating pipe 42*f* The circulating pipe 42*f* is connected at one end (upstream end) to a bottom of the cleaning tank 42*a* and at the other end (downstream end) to a side surface of the cleaning tank 42*a*. During cleaning of a pad, a water circulating action is performed in which the circulating pump 42*g* is activated to extract water from the bottom of the cleaning tank 42*a* and this water is purified by the filter 42*h* and then returned to the cleaning tank 42*a* through the side surface. A drain valve 42*i* is connected to the filter 42*h*. The drain valve 42*i* is opened to discharge water from the cleaning tank 42*a*.

Pad Draining Unit

The pad draining unit 43 drains the cushion pad 55 that has been cleaned by the pad cleaning unit 42.

Figure 6:
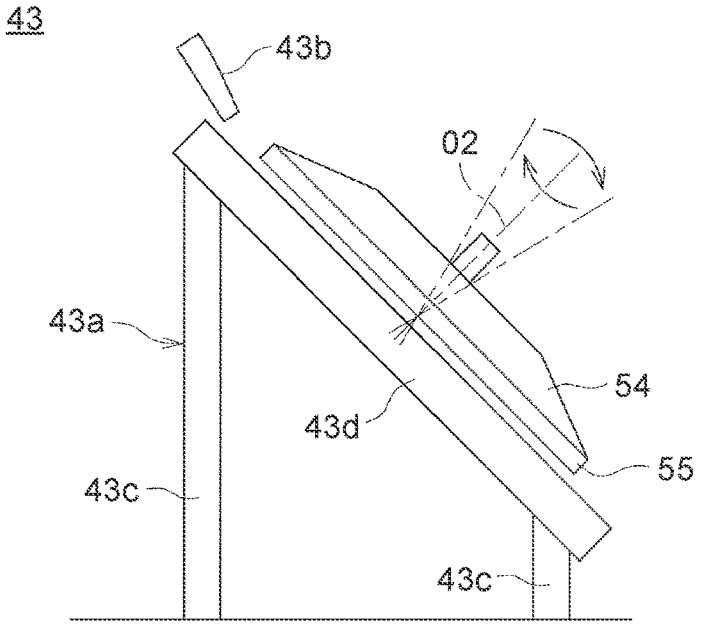
FIG. 6 is a schematic configuration view of a pad draining unit.

As shown in FIG. 6, the pad draining unit 43 includes a draining table 43*a* and an air blow nozzle 43*b*. The draining table 43*a* is composed of a rack frame 43*c* and a mesh-like inclined plate 43*d* mounted thereon. To drain the cushion pad 55, the automatic wet sanding robot 3 is operated to press the cushion pad 55 against the inclined plate 43*d* of the draining table 43*a*, and water is thereby squeezed out from the cushion pad 55. During draining, air is blown from the air blow nozzle 43*b* toward the cushion pad 55 to increase the draining efficiency. An air blow motor 43*e* (see FIG. 8) is connected to the air blow nozzle 43*b*.

The cushion pad 55 may be pressed against the inclined plate 43*d* of the draining table 43*a* such that the entire cushion pad 55 is evenly pressed against the inclined plate 43*d*. However, it is preferable that the position at which the cushion pad 55 is pressed against the inclined plate 43*d* be changed in a circumferential direction of the cushion pad 55, as it can further increase the draining efficiency. Specifically, the position at which the cushion pad 55 is pressed against the inclined plate 43*d* is changed in the circumferential direction by moving the center line O2 (center positions) of the disc 54 and the cushion pad 55 as indicated by the arrows in FIG. 6.

Paper Mounting Unit

The paper mounting unit 44 mounts new sandpaper 56 onto the cushion pad 55 that has been drained by the pad draining unit 43.

As shown in FIG. 2, the paper mounting unit 44 includes a paper stand 44*a* and a paper pressing plate 44*b*. A plurality of sheets of unused sandpaper 56 is placed on top of one another on the paper stand 44*a*. Each sheet of sandpaper 56 is placed on the paper stand 44*a* in such a manner that the surface having a touch-and-close fastener to be mounted to the cushion pad 55 faces upward.

An air cylinder 44*c* is connected to the paper pressing plate 44*b*. The air cylinder 44*c* is activated to move the paper pressing plate 44*b* between a position at which the paper pressing plate 44*b* presses the upper side of the sandpaper 56 and a position at which the paper pressing plate 44*b* has receded from the sandpaper 56. The paper pressing plate 44*b* has a U-shaped cutout 44*d*, and when the paper pressing plate 44*b* is located at the position at which the paper pressing plate 44*b* presses the upper side of the sandpaper 56 as shown in FIG. 2, part of the touch-and-close fastener of the sandpaper 56 is exposed upward. In this state, the cushion pad 55 is pressed against the upper surface of the sandpaper 56, and then the paper pressing plate 44*b* recedes from the sandpaper 56, so that the entire touch-and-close fastener of the sandpaper 56 is mounted to the cushion pad 55.

Paper Checking Unit

In a state where the sandpaper 56 has been mounted on the cushion pad 55 by the paper mounting unit 44, the paper checking unit 45 checks whether or not the mounting position of the sandpaper 56 is the correct position.

Figure 7:
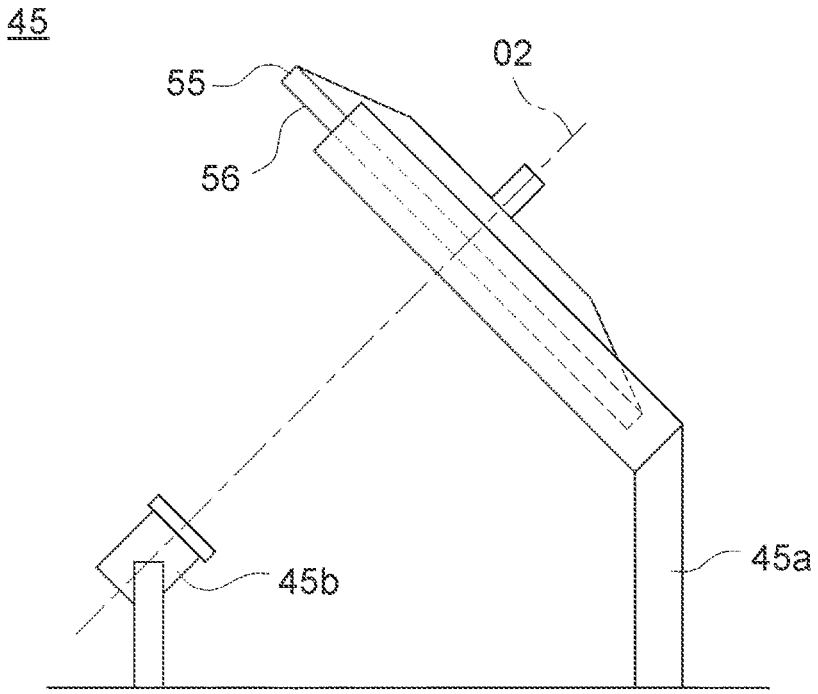
FIG. 7 is a schematic configuration view of a paper checking unit.

As shown in FIG. 7, the paper checking unit 45 includes a stand 45*a* and a camera 45*b*. The stand 45*a* includes a pair of plates 45*c* (see FIG. 2) disposed at an interval that is substantially equal to the outside diameter of the cushion pad 55, and a positioning plate 45*d* that couples the plates 45*c* together at ends on one side. The camera 45*b* is disposed under the stand 45*a* and takes an image of the cushion pad 55 (with the sandpaper 56 mounted thereon) placed on the stand 45*a*. The posture of the camera 45*b* is set such that the center line O2 of the cushion pad 55 in a state of being placed on the stand 45*a* and a center line of the camera 45*b* coincide with each other. Whether or not the mounting position of the sandpaper 56 is the correct position is checked by using data of the image of the cushion pad 55 and the sandpaper 56 taken by the camera 45*b*.

Control System

Figure 8:
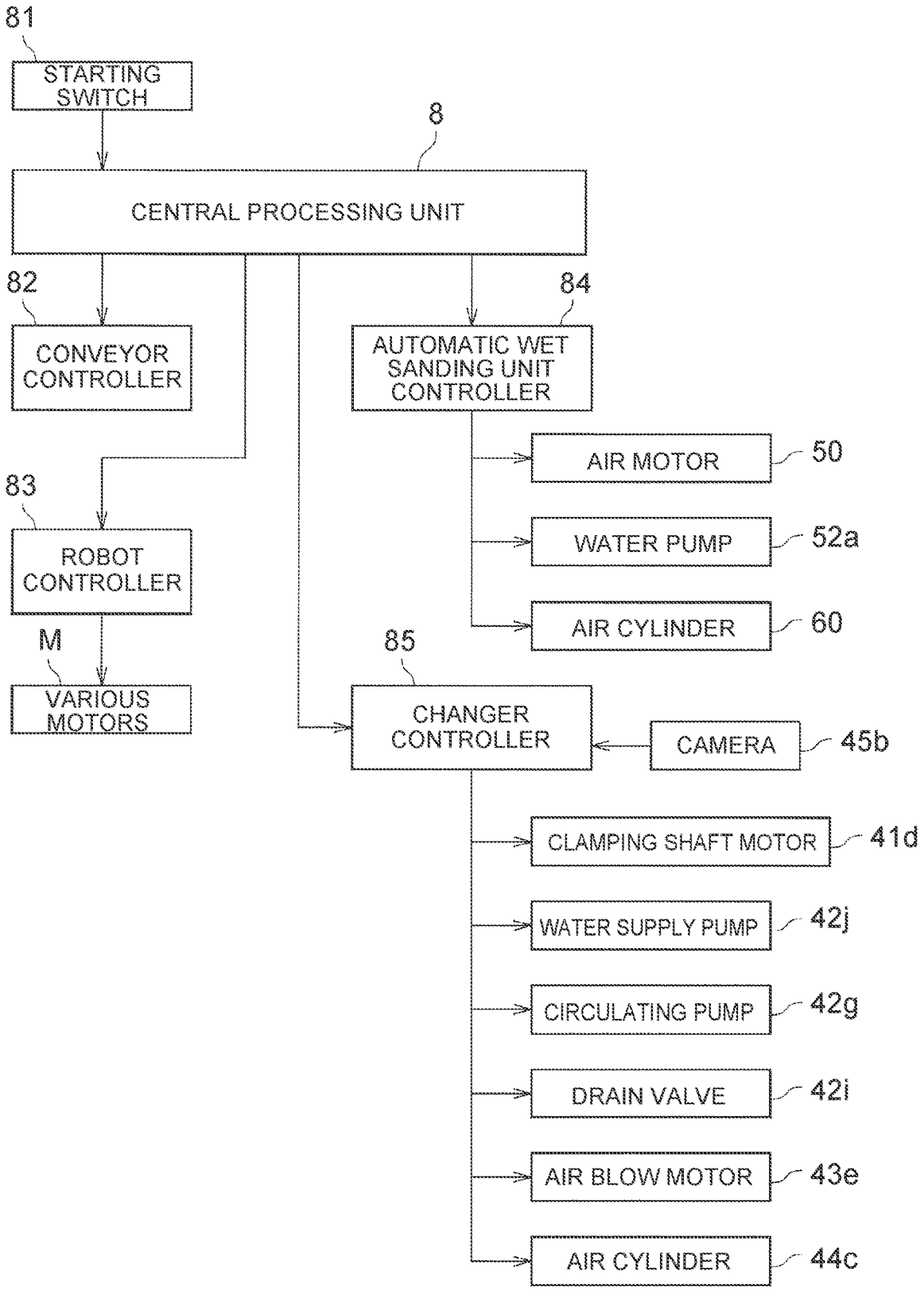
FIG. 8 is a block diagram illustrating a control system of the automatic wet sanding apparatus.

Next, a control system of the automatic wet sanding apparatuses 21 to 24 will be described. FIG. 8 is a block diagram illustrating the control system of the automatic wet sanding apparatuses 21 to 24.

As shown in FIG. 8, the control system of the automatic wet sanding apparatuses 21 to 24 has a configuration in which a starting switch 81, a conveyor controller 82, the robot controller 83, an automatic wet sanding unit controller 84, and a changer controller 85 are electrically connected to a central processing unit 8 that comprehensively controls the automatic wet sanding apparatuses 21 to 24, such that various signals including command signals can be sent and received between the central processing unit 8 and these components.

The starting switch 81 sends a command signal for starting the automatic wet sanding apparatuses 21 to 24 to the central processing unit 8 according to operation by a worker. When this start command signal is received, the automatic wet sanding apparatuses 21 to 24 are started (activated) to start an automatic wet sanding operation to be described later.

The conveyor controller 82 controls transfer of the vehicle body V by the conveyor 11. Specifically, the conveyor controller 82 operates the conveyor 11 until the vehicle body V that is an object of automatic wet sanding reaches a predetermined position (the position shown in FIG. 1) in the automatic wet sanding station 1, and temporarily stops the conveyor 11 at that point. When a predetermined time has elapsed after completion of automatic wet sanding by the automatic wet sanding apparatuses 21 to 24, the conveyor controller 82 operates the conveyor 11 again to transfer the vehicle body V having undergone automatic wet sanding to the next station, and operates the conveyor 11 until the vehicle body V that is the next object of automatic wet sanding reaches the predetermined position in the automatic wet sanding station 1.

The robot controller 83 controls the automatic wet sanding robots 3 of the respective automatic wet sanding apparatuses 21 to 24. The robot controller 83 sends command signals to various motors M that are provided in the rotating mechanisms of each automatic wet sanding robot 3 according to information on teaching that is performed on the automatic wet sanding robot 3 in advance. Thus, the robot controller 83 controls the position of the automatic wet sanding unit 5 based on the teaching information.

The automatic wet sanding unit controller 84 controls the automatic wet sanding unit 5. The water pump 52*a*, the air motor 50, and the air cylinders 60 are connected to the automatic wet sanding unit controller 84.

The water pump 52*a* is activated in accordance with a command signal from the automatic wet sanding unit controller 84 and supplies water for automatic wet sanding to the introduction space 51*a* of the skirt 51 through the water supply pipe 52. The air motor 50 is activated in accordance with a command signal from the automatic wet sanding unit controller 84 and rotates the driving shaft 50*a*. The air cylinders 60 are activated in accordance with a command signal from the automatic wet sanding unit controller 84 and move the piston rods 61A forward and backward. Thus, the automatic wet sanding unit 5 is moved forward and backward and the posture thereof is changed.

The changer controller 85 controls the units 41 to 45 of the changer 4. The clamping shaft motor 41*d*, the water supply pump 42*j*, the circulating pump 42*g*, the drain valve 42*i*, the air blow motor 43*e*, the air cylinder 44*c*, and the camera 45*b* are connected to the changer controller 85.

In the step of peeling the sandpaper 56 from the cushion pad 55 by the paper peeling unit 41, the clamping shaft motor 41*d* is activated by a command signal from the changer controller 85 and rotates the clamping shaft 41*a*. In the step of cleaning the cushion pad 55 by the pad cleaning unit 42, a water supplying action by the water supply pump 42*j*, a water circulating action by the circulating pump 42*g*, and a water discharging action by the drain valve 42*i* are performed in accordance with command signals from the changer controller 85. In the step of draining the cushion pad 55 by the pad draining unit 43, the air blow motor 43*e* is activated by a command signal from the changer controller 85 and blows air toward the cushion pad 55. In the step of mounting the sandpaper 56 onto the cushion pad 55 by the paper mounting unit 44, the air cylinder 44*c* is activated by a command signal from the changer controller 85 and the paper pressing plate 44*b* is moved between the position at which the paper pressing plate 44*b* presses the upper side of the sandpaper 56 and the position at which the paper pressing plate 44*b* has receded from the sandpaper 56.

The changer controller 85 receives imaging data (data of an image of the cushion pad 55 with the sandpaper 56 mounted thereon) from the camera 45*b* provided in the paper checking unit 45 and determines whether or not the sandpaper 56 is mounted at the correct position.

Automatic Wet Sanding Operation

Next, the automatic wet sanding operation of the vehicle body V in the automatic wet sanding station 1 configured as described above will be described.

Figure 9:
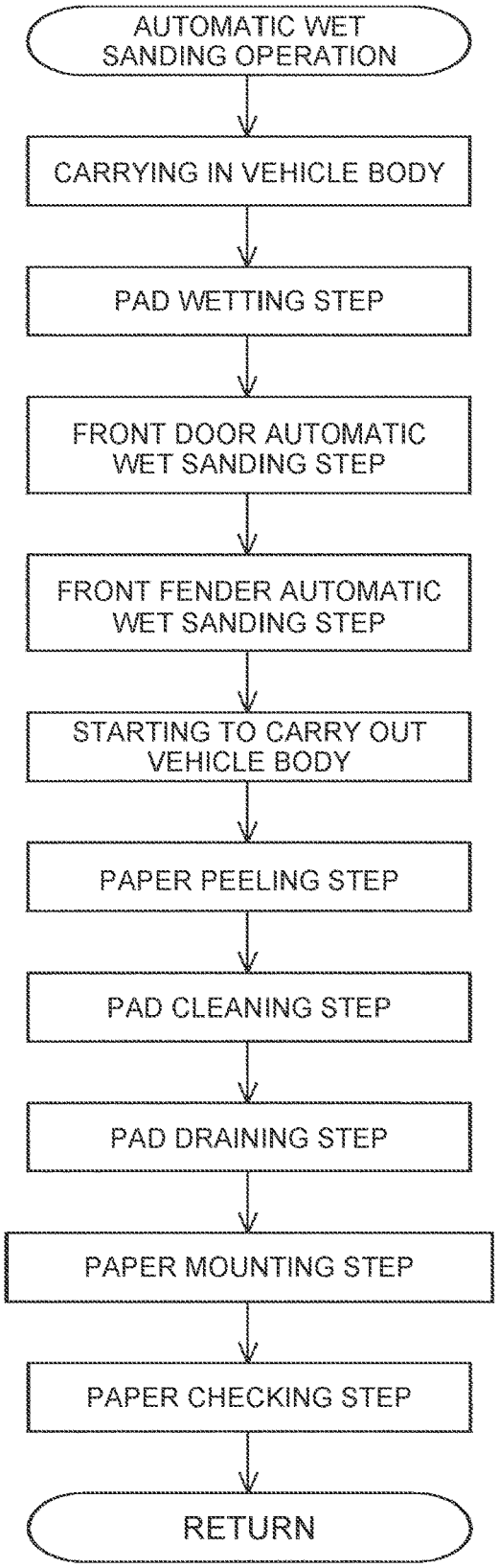
FIG. 9 is a flowchart illustrating an automatic wet sanding operation by the automatic wet sanding apparatus.

FIG. 9 is a flowchart illustrating the automatic wet sanding operation by the first automatic wet sanding apparatus 21. The same automatic wet sanding operation is concurrently performed in the other automatic wet sanding apparatuses 22 to 24.

As shown in FIG. 9, in the automatic wet sanding operation by the first automatic wet sanding apparatus 21, the following steps are sequentially performed after "carrying in vehicle body": a pad wetting step, front door automatic wet sanding step, front fender automatic wet sanding step, starting to carry out vehicle body, paper peeling step, pad cleaning step, pad draining step, paper mounting step, and paper checking step.

Carrying in Vehicle Body

In the step of carrying in the vehicle body, the conveyor 11 is activated by a command signal from the conveyor controller 82, and the vehicle body V that is an object of automatic wet sanding is transferred to the predetermined position (the position shown in FIG. 1) in the automatic wet sanding station 1. Then, the conveyor 11 stops. The conveyor 11 is kept in the stopped state until a predetermined time elapses that is when automatic wet sanding by each of the automatic wet sanding apparatuses 21 to 24 is completed.

Pad Wetting Step

In the pad wetting step, the automatic wet sanding robot 3 is operated by a command signal from the robot controller 83, and the automatic wet sanding unit 5 is immersed in water stored in the cleaning tank 42*a* of the pad cleaning unit 42. Specifically, the water supply pump 42*j* is activated by a command signal from the changer controller 85 and water is supplied to the cleaning tank 42*a*, and with the water thus stored in the cleaning tank 42*a*, the automatic wet sanding unit 5 is immersed in the water inside the cleaning tank 42*a*. In this way, the sandpaper 56 and the cushion pad 55 are wetted before the automatic wet sanding process is started.

Front Door Automatic Wet Sanding Step

In the front door automatic wet sanding step, the automatic wet sanding robot 3 is operated to move the automatic wet sanding unit 5 to a position at which it faces the front door (in the case of the first automatic wet sanding apparatus 21, the left front door LFD) (see FIG. 3). Then, the automatic wet sanding unit 5 is activated by a command signal from the automatic wet sanding unit controller 84.

Specifically, the water pump 52*a* is activated to supply water for automatic wet sanding to the introduction space 51*a* of the skirt 51 through the water supply pipe 52.

Figure 10:
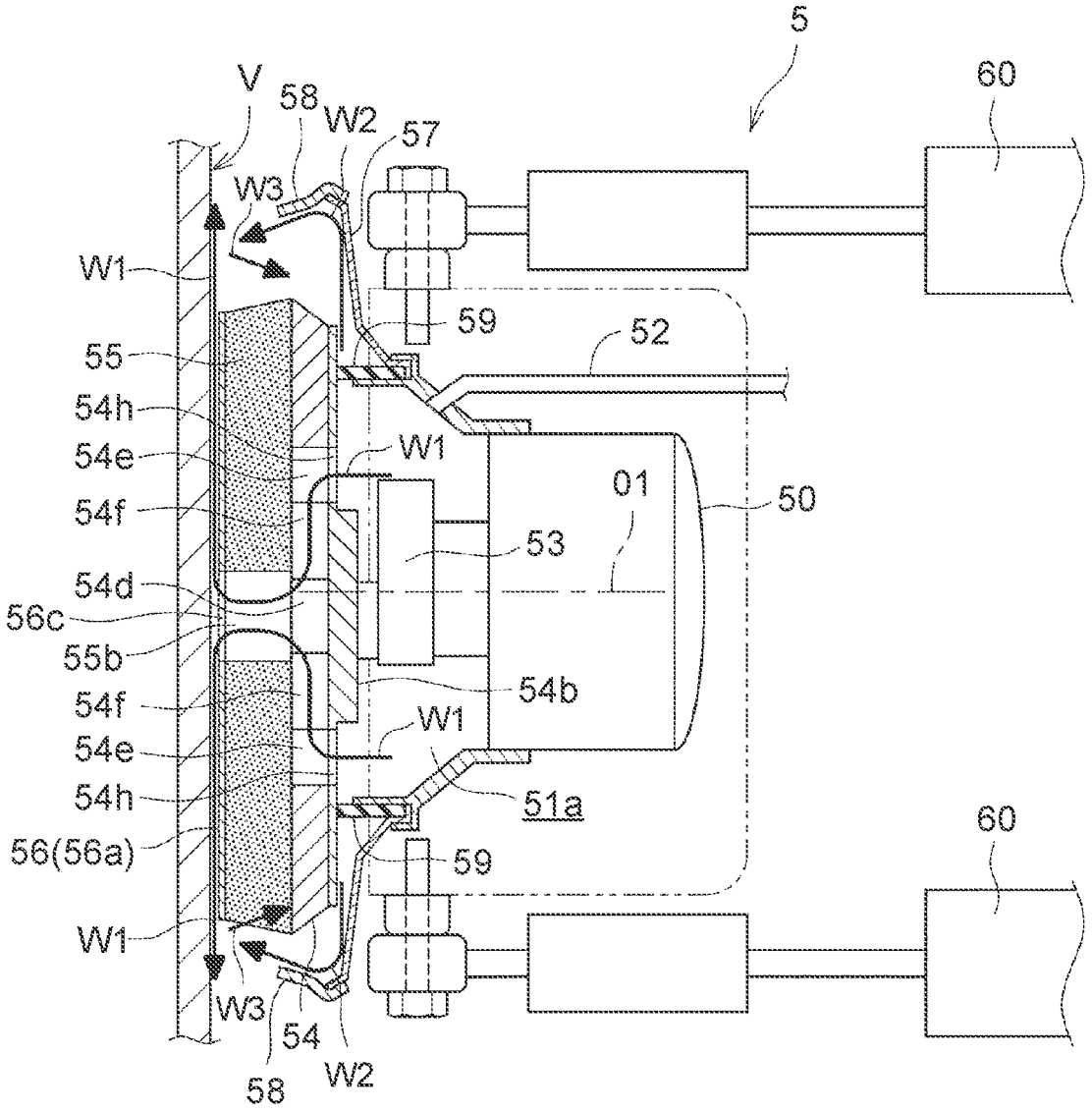
FIG. 10 is a sectional view illustrating flows of water in the automatic wet sanding unit in a state of performing automatic wet sanding.

Further, the air motor 50 is activated to rotate the driving shaft 50*a*. As the driving shaft 50*a* rotates, the eccentric head 53 rotates eccentrically in the introduction space 51*a* of the skirt 51. The eccentric head 53 rotates eccentrically in the water present in the introduction space 51*a*. As the water in the introduction space 51*a* is thus stirred, the pressure of the water in the introduction space 51*a* becomes higher. As described above, the introduction space 51*a* communicates with the water channel 54*i* that continues through the openings 54*h* of the disc cover 54*b* and the disc holes 54*e*, the communication passages 54*f*, and the disc center hole 54*d* of the disc main body 54*a*. Therefore, the water stirred in the introduction space 51*a* is pushed out to the openings 54*h* of the disc cover 54*b*. FIG. 10 is a sectional view illustrating flows of water in the automatic wet sanding unit 5 in a state of performing automatic wet sanding. (FIG. 10 is a view of a section located at a position corresponding to line X-X in FIG. 4B.) As indicated by arrows W1 in FIG. 10, the water pushed out of the introduction space 51*a* to the openings 54*h* of the disc cover 54*b* flows from the openings 54*h* through the disc holes 54*e*, the communication passages 54*f*, and the disc center hole 54*d*. The water having passed through the disc center hole 54*d* passes through the pad center hole 55*b* of the cushion pad 55 and is pumped toward the painted surface of the vehicle body V through the paper center hole 56*c* of the sandpaper 56. Then, in the automatic wet sanding process, this water flows into the gap between the sanding surface 56*a* of the sandpaper 56 and the painted surface and is pushed out from the central portion toward the outer circumferential side of the sandpaper 56 between the sanding surface 56*a* and the painted surface.

With the water thus flowing, the sanding surface 56*a* of the sandpaper 56 is pressed against the painted surface with a predetermined pressure, and with the water flowing between the sanding surface 56*a* and the painted surface, the automatic wet sanding robot 3 is operated to move the sandpaper 56 along the painted surface of the left front door LFD to sand down the painted surface.

Since the disc 54 is rotatably supported by the eccentric head 53 as described above, the disc 54, the cushion pad 55, and the sandpaper 56 make eccentric motion (motion in which the center point of the disc 54 moves in circles) around the center of rotation O1 of the driving shaft 50*a*, without being forced to rotate when the eccentric head 53 rotates eccentrically.

Figure 11:
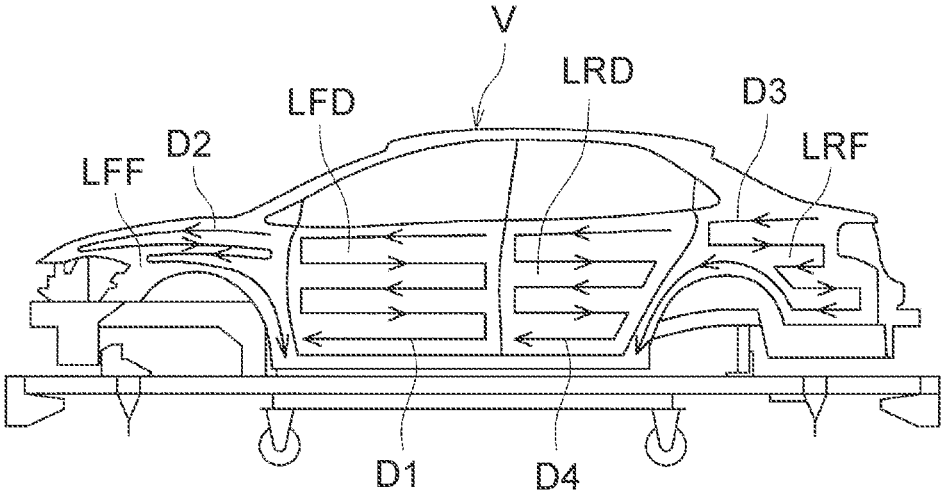
FIG. 11 is a side view of a vehicle body illustrating moving paths of the automatic wet sanding unit in the automatic wet sanding operation.

FIG. 11 is a side view of a vehicle body illustrating moving paths of the automatic wet sanding unit 5 in the automatic wet sanding operation. Arrow D1 in FIG. 11 is one example of moving paths of the automatic wet sanding unit 5 of the first automatic wet sanding apparatus 21 when the automatic wet sanding unit 5 sands down the painted surface of the left front door LFD. Arrow D2 is one example of moving paths of the automatic wet sanding unit 5 of the first automatic wet sanding apparatus 21 when the automatic wet sanding unit 5 sands down the painted surface of the left front fender LFF (when the automatic wet sanding unit 5 performs the front fender automatic wet sanding step to be described later). Arrow D3 is one example of moving paths of the automatic wet sanding unit 5 of the third automatic wet sanding apparatus 23 when the automatic wet sanding unit 5 sands down the painted surface of the left rear fender LRF. Arrow D4 is one example of moving paths of the automatic wet sanding unit 5 of the third automatic wet sanding apparatus 23 when the automatic wet sanding unit 5 sands down the painted surface of the left rear door LRD.

While automatic wet sanding on the painted surface of the left front door LFD is performed by the automatic wet sanding unit 5 of the first automatic wet sanding apparatus 21, automatic wet sanding on the painted surface of the left rear fender LRF is performed by the automatic wet sanding unit 5 of the third automatic wet sanding apparatus 23. While automatic wet sanding on the painted surface of the left front fender LFF is performed by the automatic wet sanding unit 5 of the first automatic wet sanding apparatus 21, automatic wet sanding on the painted surface of the left rear door LRD is performed by the automatic wet sanding unit 5 of the third automatic wet sanding apparatus 23. This is to prevent the automatic wet sanding robot 3 of the first automatic wet sanding apparatus 21 and the automatic wet sanding robot 3 of the third automatic wet sanding apparatus 23 from coming too close to each other during automatic wet sanding.

Since water is pushed out toward the painted surface via the disc center hole 54*d* and the pad center hole 55*b* in automatic wet sanding as described above, automatic wet sanding is performed while water is pushed out from the central portion toward the outer circumferential side of the sandpaper 56 between the sandpaper 56 and the painted surface. Thus, sanding dust resulting from automatic wet sanding is washed away toward the outer circumferential side by water that is pushed out toward the outer circumferential side, so that sanding dust is less likely to remain around the sandpaper 56. As a result, automatic wet sanding can be performed with the likelihood of clogging due to sanding dust being reduced.

Figure 12:
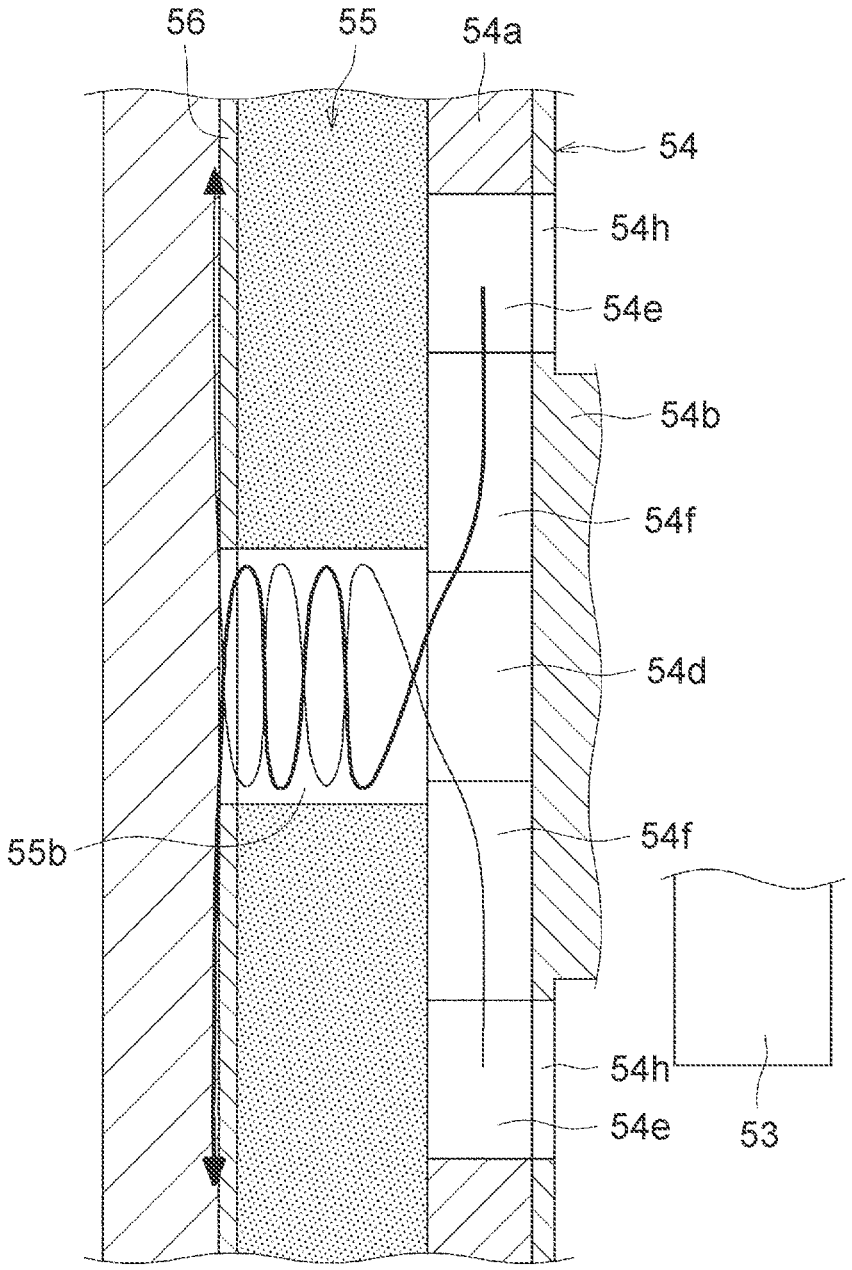
FIG. 12 is a sectional view illustrating flows of water inside a disc and a cushion pad.

In the following, flows of water inside the disc 54 and the cushion pad 55 will be described in detail. FIG. 12 is a sectional view illustrating the flows of water inside the disc 54 and the cushion pad 55. As shown in FIG. 12, water that has been pushed out into the openings 54*h* of the disc cover 54*b* as the eccentric head 53 rotates eccentrically flows through the communication passages 54*f* via the disc holes 54*e* and thereby flows toward the central portion of the disc main body 54*a*. Upon reaching the disc center hole 54*d* of the disc main body 54*a*, the water flows from the disc center hole 54*d* into the pad center hole 55*b* of the cushion pad 55. Here, the water hits an inner wall surface of the pad center hole 55*b* and forms a swirling flow that moves along the inner wall surface. Specifically, since the disc main body 54*a* has the disc hole 54*e* and the communication passage 54*f* provided at three positions, water flows into the disc center hole 54*d* from three directions, and these flows of water merge with one another in the disc center hole 54*d* and then move into the pad center hole 55*b* to form a swirling flow. As described above, the inside diameter of the pad center hole 55*b* is slightly larger than the inside diameter of the disc center hole 54*d*. Therefore, when water is pushed out of the relatively small-diameter disc center hole 54*d* toward the relatively large-diameter pad center hole 55*b*, the water is subjected to a large centrifugal force in the pad center hole 55*b*, which can enhance the pressure of the water that is pushed out of the pad center hole 55*b* toward the painted surface. This also contributes to effectively washing away sanding dust toward the outer circumferential side and thereby reliably reducing the likelihood of clogging due to sanding dust.

The following flow of water also occurs inside the automatic wet sanding unit 5. As water in the introduction space 51*a* is stirred by eccentric rotation of the eccentric head 53, the water pressure rises and this water pressure acts on the seal member 59. As shown in FIG. 4A, the upper end portion of the seal member 59 is inserted and supported in the engaging groove 51*e* of the skirt 51, while a lower end portion thereof is not supported and is in contact with the upper surface of the disc 54 along the entire circumference of the seal member 59. Therefore, when a water pressure acts on the seal member 59 and this water pressure exceeds a predetermined value, the lower end portion of the seal member 59 deforms elastically toward the outer circumferential side, leaving a small clearance between the lower end of the seal member 59 and the upper surface of the disc 54. Water flows through this clearance. Arrows W2 in FIG. 10 indicate this flow of water. The water thus flowing out toward the outer circumferential side through the clearance between the seal member 59 and the disc 54 collides with the water deflecting part 57*c* of the hood 57 and changes its flow direction to a direction toward the painted surface of the vehicle body V. Then, the water collides with the water deflecting member 58 and changes its flow direction so as to be directed toward the center side (the side toward the cushion pad 55) while flowing toward the painted surface of the vehicle body V. Inner surfaces of the hood 57 and the water deflecting member 58 are cleaned by this flow of water, and sanding dust adhering to these inner surfaces, if any, is removed. Then, the water collides with the painted surface of the vehicle body V and is sent (bounced) back by the painted surface, and changes its flow direction so as to be directed toward the center side (the side toward the disc 54) while flowing away from the painted surface of the vehicle body V (see arrows W3 in FIG. 10). In this process, sanding dust adhering to the painted surface of the vehicle body V, if any, is removed from the painted surface by the water that collides with and bounces off the painted surface and the painted surface is cleaned. As the water thus undergoes changes in the flow direction, the water having flowed out toward the outer circumferential side through the clearance between the seal member 59 and the disc 54 is collected to the inner side of the hood 57 and the inner side of the water deflecting member 58 and unlikely to scatter widely in a peripheral part of the automatic wet sanding unit 5. It is therefore unlikely that paint separated from the vehicle body V by automatic wet sanding may adhere to a wide area of the vehicle body V.

Front Fender Automatic Wet Sanding Step

When the front door automatic wet sanding step is completed, the operation of the automatic wet sanding unit 5 is temporarily stopped, and then the front fender automatic wet sanding step is started. In the front fender automatic wet sanding step, the automatic wet sanding robot 3 is operated to move the automatic wet sanding unit 5 to a position at which it faces the front fender (in the case of the first automatic wet sanding apparatus 21, the left front fender LFF). Then, the automatic wet sanding unit 5 is activated by a command signal from the automatic wet sanding unit controller 84. The operation of the automatic wet sanding unit 5 in this step is the same as in the front door automatic wet sanding step described above and therefore will not be described here.

Starting to Carry Out Vehicle Body

When the front door automatic wet sanding step is completed, the operation of the automatic wet sanding unit 5 is stopped and the vehicle body V starts to be carried out. Specifically, the conveyor 11 is activated to transfer the vehicle body V that has undergone automatic wet sanding toward the next station.

Paper Peeling Step

As the vehicle body V starts to be carried out, the paper peeling step by the paper peeling unit 41 provided in the changer 4 is performed. In the paper peeling step, the automatic wet sanding robot 3 is operated to move the automatic wet sanding unit 5 to a position at which the sandpaper 56 is caught between the clamping shaft 41*a* and the clamping hook 41*b*, and then the automatic wet sanding unit 5 is moved upward to thereby peel the sandpaper 56 from the cushion pad 55. Thereafter, the clamping shaft motor 41*d* is activated to rotate the clamping shaft 41*a*, so that the sandpaper 56 peeled from the cushion pad 55 drops into the sandpaper collection box 41*e* to be collected.

Pad Cleaning Step

In the pad cleaning step by the pad cleaning unit 42, cleaning water (pure water) is supplied to the cleaning tank 42*a* as the water supply pump 42*j* is activated, and the water is circulated through the circulating circuit 42*c* as the circulating pump 42*g* is activated. In this state, the automatic wet sanding robot 3 is operated to move the automatic wet sanding unit 5 into the cleaning tank 42*a*, and the cushion pad 55 is pressed against the metal mesh 42*d* to squeeze out water (water with paint mixed therein) contained in the cushion pad 55. Then, the automatic wet sanding unit 5 is slightly raised to separate the cushion pad 55 from the metal mesh 42*d*. In this state, the air motor 50 is activated and the cushion pad 55 is rotated (eccentrically rotated) in the water to clean the cushion pad 55. As the circulating pump 42*g* operates during these actions, water is circulated by being extracted from the bottom of the cleaning tank 42*a* and purified by the filter 42*h* and then returned to the cleaning tank 42*a* through the side surface of the cleaning tank 42*a*. Thereafter, the automatic wet sanding unit 5 is further slightly raised to move the cushion pad 55 to above the level of the water in the cleaning tank 42*a*, and the air motor 50 is activated again to drain the cushion pad 55 using a centrifugal force. Meanwhile, the drain valve 42*i* is opened to discharge the water from the cleaning tank 42*a*.

Pad Draining Step

In the pad draining step by the pad draining unit 43, the automatic wet sanding robot 3 is operated to press the cushion pad 55 against the inclined plate 43*d* of the draining table 43*a*, and water is thereby squeezed out of the cushion pad 55. In this process, the center line O2 of the disc 54 and the cushion pad 55 is moved as indicated by the arrows in FIG. 6 such that the position at which the cushion pad 55 is pressed against the inclined plate 43*d* is changed in the circumferential direction of the cushion pad 55. During draining, the air blow motor 43*e* is activated to blow air from the air blow nozzle 43*b* toward the cushion pad 55 and thereby increase the draining efficiency.

Paper Mounting Step

In the paper mounting step by the paper mounting unit 44, with the paper pressing plate 44*b* pressing the upper side of the sandpaper 56 as shown in FIG. 2, the automatic wet sanding robot 3 is operated to press the cushion pad 55 against the upper surface of the sandpaper 56. In this state, the air cylinder 44*c* is activated to move the paper pressing plate 44*b* away from the sandpaper 56, so that the entire touch-and-close fastener of the sandpaper 56 is mounted to the cushion pad 55. Since the cushion pad 55 is rotatably supported by the bearing 53*a*, it is preferable that at a stage preceding the paper mounting step, the cushion pad 55 be pressed against a positioning plate (not shown) to adjust the posture of the cushion pad 55 relative to the center of rotation O1 of the driving shaft 50*a* (the phase position of the cushion pad 55 in the offset direction) to a correct posture.

Paper Checking Step

In the paper checking step by the paper checking unit 45, the automatic wet sanding robot 3 is operated to place the cushion pad 55 (with the sandpaper 56 mounted thereon) on the stand 45*a* as shown in FIG. 7, and the outer circumferential surface of the cushion pad 55 is pressed against the plates 45*c* and the positioning plate 45*d*. In this state, an image of the cushion pad 55 and the sandpaper 56 is taken from below by the camera 45*b*. This imaging data is sent to the central processing unit 8 through the changer controller 85, and the central processing unit 8 checks whether or not the mounting position of the sandpaper 56 is the correct position. When it is determined that the mounting position of the sandpaper 56 is the correct position, the automatic wet sanding operation starting from the pad wetting step is performed on the next vehicle body V that has been transferred to the predetermined position in the automatic wet sanding station 1 by the step of carrying in the vehicle body. On the other hand, when it is determined that the mounting position of the sandpaper 56 is not the correct position, the action of mounting the sandpaper 56 is redone. To redo the mounting action, for example, the paper peeling step and the paper mounting step are sequentially performed.

The actions from "carrying in vehicle body" to the "paper checking step" are repeatedly performed to sequentially perform automatic wet sanding on each of vehicle bodies V transferred to the automatic wet sanding station 1.

Advantages of Embodiment

In the embodiment, as has been described above, to change the direction of water flowing toward a painted surface of the vehicle body V so as to flow toward the center side of the hood 57, the water deflecting member 58 is provided that extends toward the center side of the hood 57 while extending toward the painted surface as seen in a state where automatic wet sanding is performed. Thus, water bouncing off the painted surface is less likely to scatter over a wide area of the painted surface, and sanding dust is also less likely to scatter over a wide area of the painted surface. As a result, it is possible to achieve a quality finish on the painted surface while eliminating the need for the troublesome task of wiping off sanding dust remaining on the painted surface.

Since the water deflecting member 58 is made of rubber, the water deflecting member 58 can hinder the hood 57 from coming directly into contact with the painted surface of the vehicle body V when the angle of the skirt 51 or the disc 54 relative to the painted surface changes. Even if the water deflecting member 58 comes into contact with the painted surface, the water deflecting member 58, being made of rubber, is less likely to damage the painted surface and therefore the painted surface can be protected.

In the embodiment, the position of the leading end edge of the hood 57 closer to the painted surface is set to a position that is on the side farther away from the vehicle body V relative to a position in the disc 54 that is closer to the painted surface. This means that there is a clearance, wider than the thickness of the cushion pad 55, between the painted surface and the leading end edge of the hood 57 closer to the painted surface. Thus, a sufficient clearance between the hood 57 and the painted surface can be secured to hinder the hood 57 from coming directly close to the painted surface and protect the painted surface. In addition, the units 41 to 45 and the hood 57 are less likely to interfere with each other during replacement of the sandpaper 56 by the changer 4.

Other Embodiments

The present disclosure is not limited to the above embodiment and all modifications and applications encompassed by the scope of the claims and an equivalent scope are possible.

For example, in the above embodiment, the case has been described in which the present disclosure is applied to the automatic wet sanding apparatuses 21 to 24 for which the painted object is the vehicle body V and which perform automatic wet sanding on the painted surfaces of the vehicle body V. The painted object in the present disclosure is not limited to the vehicle body V, and the disclosure is applicable to automatic wet sanding apparatuses for various painted objects.

In the above embodiment, the sandpaper 56 has the paper center hole 56*c* at the central portion and water is pushed out toward the painted surface via the paper center hole 56*c*. The present disclosure is not limited to this configuration, and for example, when the entire sandpaper 56 is made of a water absorbing material, such as sponge, the paper center hole is not absolutely necessary and water pushed out of the pad center hole 55*b* of the cushion pad 55 flows toward the painted surface through the sandpaper 56. Also in this case, water is pushed out from the central portion toward the outer circumferential side of the sandpaper 56 between the sandpaper 56 and the painted surface, so that automatic wet sanding can be performed with the likelihood of clogging due to sanding dust being reduced.

The sandpaper is used as a sanding sliding body in the above embodiment, but a sanding brush may instead be used.

The air motor 50 is used as a rotation power source in the above embodiment, but an electric motor or the like may instead be used.

The present disclosure is applicable to an automatic wet sanding apparatus that performs automatic wet sanding on a painted surface of a vehicle body.

What is claimed is:

1. An automatic wet sanding apparatus that performs automatic wet sanding in which a sanding sliding body is pressed against a painted surface of a painted object that has been painted and, while water is supplied toward the painted surface, the sanding sliding body is moved to sand down the painted surface, the automatic wet sanding apparatus comprising:

a case that forms an introduction space of the water;

a water supply pipe that supplies water to the introduction space;

a disc that moves integrally with the sanding sliding body and is located closer to the painted surface than the introduction space is in a state where the automatic wet sanding is performed;

a hood that is mounted on an outer circumferential part of the case and, as seen in the state where the automatic wet sanding is performed, extends toward the painted surface so as to be located on an outer circumferential side of the disc, the hood having a water deflecting portion that is bent to further extend toward the painted surface from an outer circumferential end of the hood; and a water deflecting member having an annular shape and formed of rubber that is mounted at the water deflection portion and, as seen in the state where the automatic wet sanding is performed, extends toward a center side of the hood while extending toward the painted surface so that a diameter of the water deflecting member is smaller than a diameter of the water deflecting portion.

2. The automatic wet sanding apparatus according to claim 1, wherein a diameter of an end edge of the water deflecting member closer to the painted surface is set to be smaller than a diameter of a mounting part of the water deflecting member that is mounted on the hood.

3. The automatic wet sanding apparatus according to claim 1, further comprising a cushion pad which moves integrally with the disc and on which the sanding sliding body is mounted, wherein a position of a leading end edge of the hood closer to the painted surface is set to a position that is on a side farther away from the painted object than a position in the disc that is closer to the painted surface is.

* * * * *